US011364603B2

(12) United States Patent
Liu

(10) Patent No.: US 11,364,603 B2
(45) Date of Patent: Jun. 21, 2022

(54) RATCHET WRENCH WITH ELECTRIC ASSISTANCE

(71) Applicant: You Teng Industry Co., Ltd., Taichung (TW)

(72) Inventor: Shih-Chieh Liu, Taichung (TW)

(73) Assignee: YOU TENG INDUSTRY CO., LTD., Taichung (TW)

( * ) Notice: Subject to any disclaimer, the term of this patent is extended or adjusted under 35 U.S.C. 154(b) by 196 days.

(21) Appl. No.: 16/939,288

(22) Filed: Jul. 27, 2020

(65) Prior Publication Data

US 2022/0024003 A1 Jan. 27, 2022

(51) Int. Cl.
*B25B 21/00* (2006.01)
*B25B 13/46* (2006.01)

(52) U.S. Cl.
CPC ..... *B25B 21/004* (2013.01); *B25B 13/463* (2013.01)

(58) Field of Classification Search
CPC ..... B25B 21/004; B25B 13/463
USPC ..... 81/57.13, 57.29
See application file for complete search history.

(56) References Cited

U.S. PATENT DOCUMENTS 11,167,400 B2 * 11/2021 Chan ..... B25B 23/1425
2004/0226411 A1 * 11/2004 Hsien ..... B25B 21/004 81/57.13
2016/0339568 A1 * 11/2016 Hu ..... B25B 23/141

* cited by examiner

*Primary Examiner* — Joseph J Hail
*Assistant Examiner* — Robert C Moore
(74) *Attorney, Agent, or Firm* — WPAT, PC

(57) ABSTRACT

A ratchet wrench with electric assistance includes a wrench body, a ratchet device, a pawl device, and a switch device. The switch device is configured for optionally gearing the pawl device with the ratchet device, so that the ratchet wrench is operated in a clockwise or counterclockwise direction. During the directional changing process, the switch device optionally engages the first gear and the second gear with the transmission gear of the power device, such that the power device transmits the power to the ratchet device for controlling the clockwise or counterclockwise rotation of the ratchet device, realizing the ratchet wrench with an electric assistance function.

10 Claims, 11 Drawing Sheets

RATCHET WRENCH WITH ELECTRIC ASSISTANCE

BACKGROUND OF THE INVENTION

1. Field of the Invention

The present invention relates to ratchet wrenches, and more particularly, to a ratchet wrench with electric assistance.

2. Description of the Related Art

A conventional ratchet applies a switch member for controlling the wrench to be operated for wrenching in a clockwise or counterclockwise direction, so as to facilitate the operation in a relatively narrow space or specific working site.

However, the conventional wrenches are applied for manually turning the fasten member. As a result, before the fasten member being fastened, because the wrench is in a light loading status, the fastener may simultaneously together with the ratchet wrench, thereby prevented from being fastened into the fix position, causing an inconvenience of operation.

SUMMARY OF THE INVENTION

For improving the issues above, the present invention discloses a ratchet wrench with electric assistance. When the wrench is in the light loading status, the electric assistance is applied for facilitating the screwing operation.

For achieving the aforementioned objectives, a ratchet wrench with electric assistance is provided, comprising a wrench body, a ratchet device, a pawl device, a power device, a gear device, and a switch device. The wrench body comprises a grip end and a head end. The head end comprises a housing groove. The ratchet device is rotatable disposed in the housing groove along a first axis and comprises an annular tooth. The pawl device is disposed in the housing groove and optionally geared with the annular tooth. The power device is disposed on the wrench body and comprises a transmission shaft which is driven by the power for rotation. The transmission shaft comprises a transmission gear disposed along a second axis, which is perpendicular to the first axis. The gear device is disposed in the housing groove along a third axis, which is parallel to the first axis. The gear device moves between a first position and a second position with respect to the wrench body. The gear device comprises a first gear, a second gear, and an operation shaft passing through the first gear and the second gear, wherein the operation shaft drives the first gear and the second gear to be optionally geared with the transmission gear, thereby transmits the motivation force to the annular tooth. The switch device is rotatable disposed on the wrench body and connected with the operation shaft, and capable of driving the operation shaft to move along the third axis with respect to the wrench body. When the gear device is at the first position, the first gear leaves the transmission gear, and the second gear is geared with the transmission gear, such that the transmission gear drives the annular tooth to rotate through the second gear, whereby the ratchet device is able to rotate in the clockwise direction. When the gear device is at the second position, the second gear leaves the transmission gear, and the first gear is geared with the transmission gear, such that the transmission gear drives the annular tooth to rotate through the first gear, whereby the ratchet device is able to rotate in the counterclockwise direction.

With such configuration, the ratchet wrench is allowed to be operated manually or electrically. In manual operation, the wrench is applied for driving the fastener with large torque. When the fastener is in a light loading status, the wrench is able to be operated in the electrical mode, such that the ratchet device is electrically driven for driving the fastener for screwing operation.

DETAILED DESCRIPTION OF THE INVENTION

Figure 1:
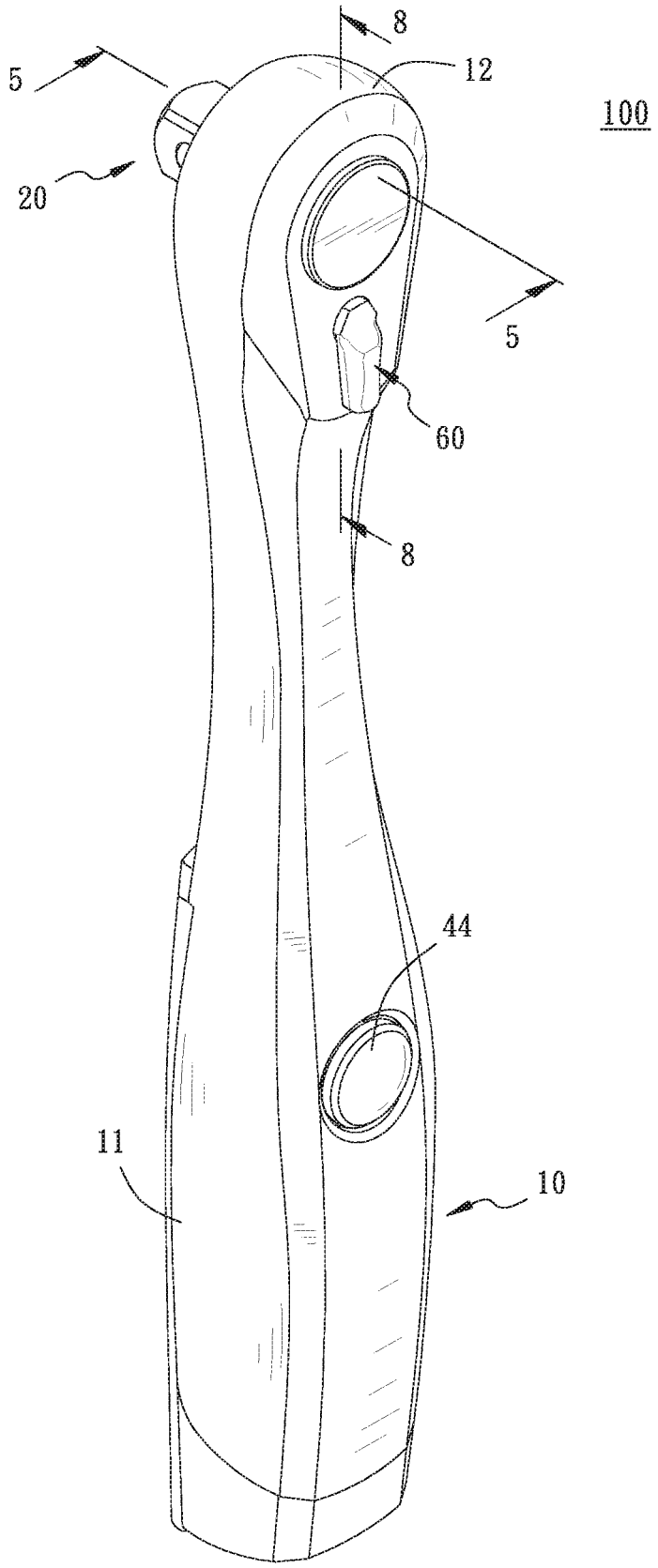
FIG. 1 is a perspective view of the ratchet wrench with electric assistance in accordance with an embodiment of the present invention.

The aforementioned and further advantages and features of the present invention will be understood by reference to the description of the preferred embodiment in conjunction with the accompanying drawings where the components are illustrated based on a proportion for explanation but not subject to the actual component proportion.

Referring to FIG. 1 to FIG. 11, a ratchet wrench 100 with electric assistance comprises a wrench body 10, a ratchet device 20, a ratchet device 30, a power device 40, a gear device 50, and a switch device 60.

The wrench body 10 comprises a grip end 11 and a head end 12, and the head end 12 comprises a housing groove 13. In the embodiment, the wrench 10 comprises a shaft body 14 and a cover body 15 that are combined, such that the aforementioned components are disposed therebetween. The housing groove 13 is formed between the shaft body 14 and the cover body 15, and comprises a first groove 131 and a second groove 132 that partially overlap and are in communication with each other. Two ends of the first groove 131 are connected with a first through hole 141 and a second through hole 151, respectively wherein the first through hole 141 is formed on the shaft body 14 and the second through hole 151 is formed on the cover body 15. Also, the shaft body 14 comprises a long groove 142 disposed along the length direction thereof and in communication with the housing groove 13. An installation bore 16 is disposed on one side of the first through hole 141 of the shaft body 14 and in communication with the second groove 132. The grip end 11 comprises a button bore 17. The housing groove 13 further comprises a spring recess 18 disposed on the cover body 15.

The ratchet device 20 is rotatable disposed in the first groove 131 of the housing groove 13 along the first axis L1, with an annular tooth 21 disposed on the outer periphery of the ratchet device 20. In the embodiment, one end of the ratchet device 20 has an engagement portion 22 protruding through the second through hole 151. The engagement portion 22 is formed in a square shape for combining a sleeve which is applied for connecting the fastener. Another end of the ratchet device 20 is exposed from the first through hole 141.

The pawl device 30 is disposed in the second groove 132 of the housing groove 13 and optionally geared with the annular tooth 21. In the embodiment, the pawl device 30 comprises a first pawl 31, a second pawl 32, and two springs 33. The first pawl 31 and the second pawl 32 are pivotally disposed in the second groove 132. Each spring 33 abuts against the inner wall of the second groove 132 and the first pawl 31 or the second pawl 32, respectively, such that the first pawl 31 and the second pawl 32 permanently move toward the annular tooth 21.

The power device 40 is disposed on the wrench body 10 and positioned between the shaft body 14 and the cover body 15. The power device 40 comprises a transmission shaft 41, a transmission gear 42, a motor 43, a button 44, and a battery 45. The transmission shaft 41 is disposed in the long groove 42, and comprises the transmission gear 42, whose tooth portion faces the second groove 132. The transmission gear 42, in the embodiment, is a bevel gear. The second axis L2 is perpendicular to the first axis L1. The motor 43 is transmittably disposed on the transmission shaft 41 on one end thereof in opposite to the transmission gear 42. In another embodiment, the motor 43 is transmittably connected with the transmission shaft 41 through a shaft coupling member 46. The button 44 is disposed on the grip end 11 and protrudes from the button bore 17. The battery 45 is disposed on a rear side of the motor 43 and electrically connected with the motor 43 and the button 44. Thus, the button 44 is operated for turning on the operation of the motor 43, whereby the transmission shaft 41 is electrically driven to rotate, so as to force the transmission gear 42 to rotate as well. In another embodiment, two support members 47 are further included and disposed on two ends of the long groove 142 for supporting the transmission shaft 41.

Figure 3:
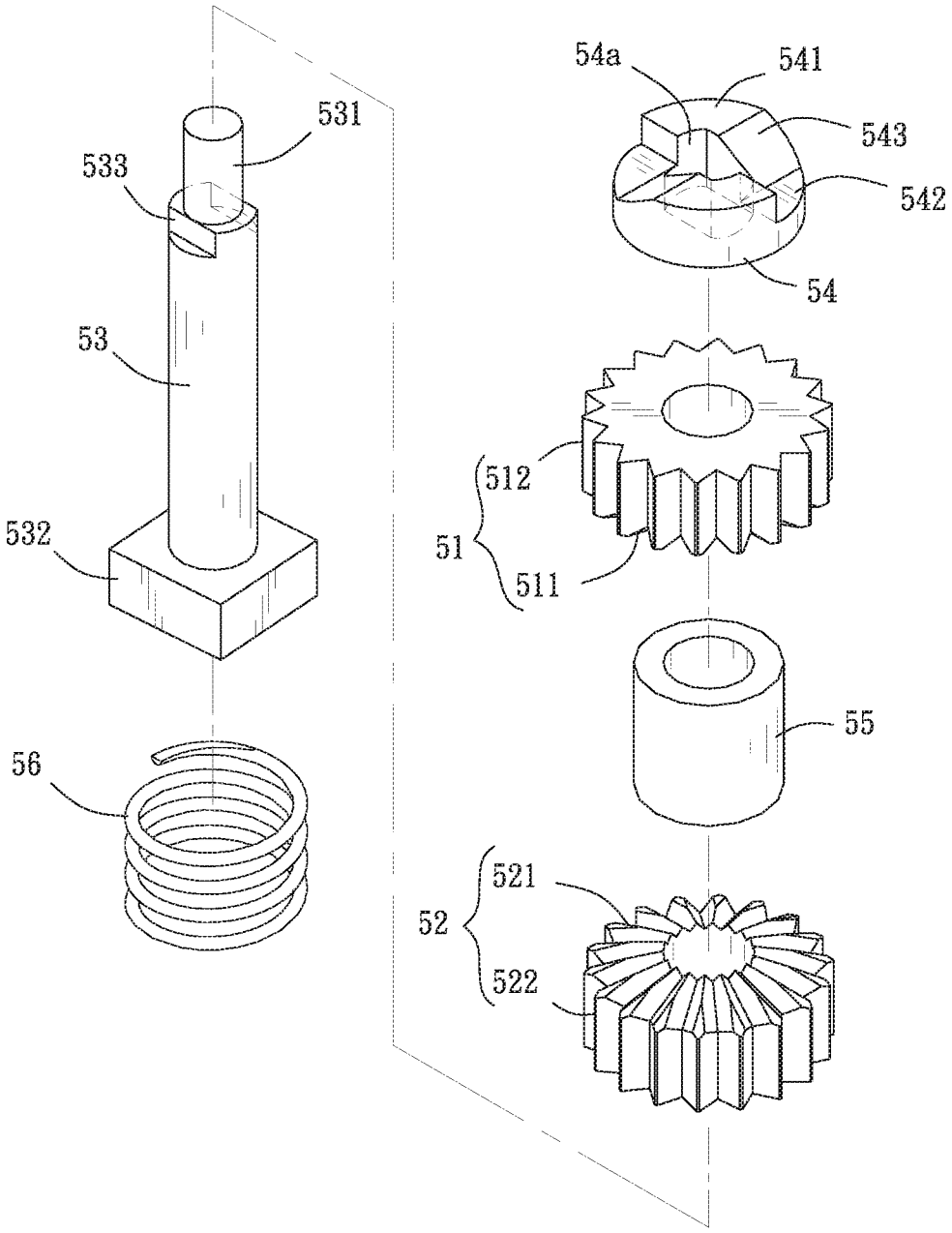
FIG. 3 is a schematic view illustrating the switch device of the ratchet wrench.
Figure 5:
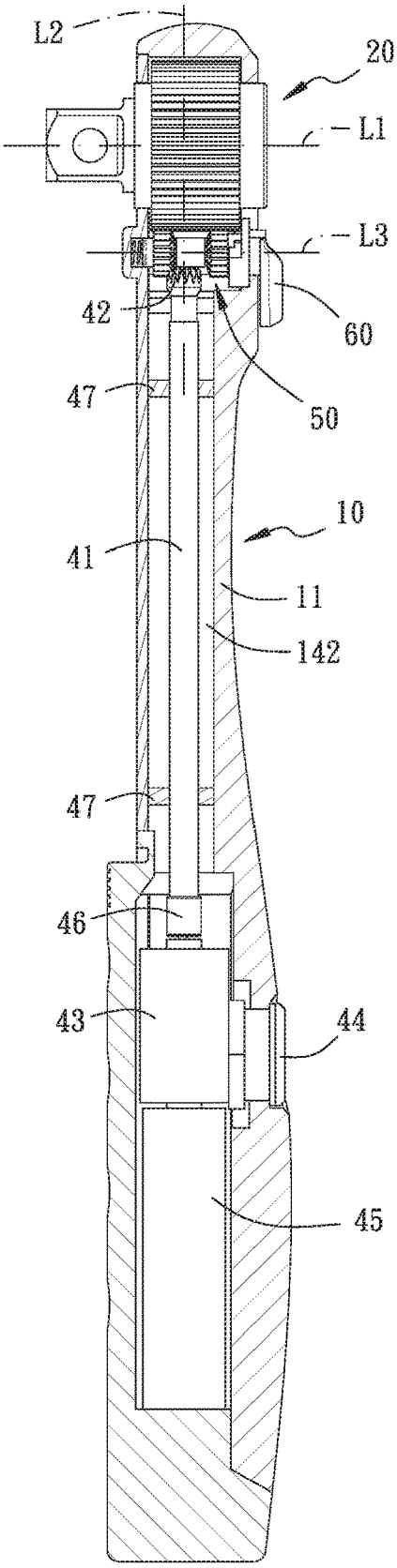
FIG. 5 is a cross-sectional view taken along line 5-5 of FIG. 1.

The gear device 50 is disposed in the second groove 132 of the housing groove 13 along a third axis L3. Also, the gear device 50 is able to move between a first position and a second position with respect to the wrench body 10. The third axis L3 is parallel to the first axis L1. The gear device 50 comprises a first gear 51, a second gear 52, and an operation shaft 53 passing through the first gear 51 and the second gear 52. In the embodiment, a push member 54 and a transmission member 55 are further included. Referring to FIG. 3 and FIG. 5, the operation shaft 53 comprises a connection end 531, an abut end 532, and a position portion 533. The position portion 533 is connected between the connection end 531 and the abut end 532. The abut end 532 of the operation shaft 53 is disposed in the spring recess 18 and pushed by an elastic member 56. Therein, the sectional faces of the spring recess 18 and the abut end 532 are formed in a non-circular shape, such that the two components are prevented from rotation with respect to each other. The position portion 533 is formed in a non-circular shape, and the push member 54 comprises a non-circular shaped engagement bore 54a for matching the engagement portion 533, such that the position portion 533 and the engagement bore 54a are prevented from rotation with respect to each other. Also, the push member 54 is disposed on one side of the first gear 51 away from the second gear 52; in other words, the first gear 51 is positioned between the push member 54 and the second gear 52. The transmission member 55 is mounted around the operation shaft 53 and positioned between the first gear 51 and the second gear 52. When the operation shaft 53 moves, the operation shaft 53 carries the first gear 51 and the second gear 52 to be optionally geared by the transmission gear 42, so as to transmit the motivation force to the annular tooth 21. In the embodiment, the first gear 51 comprises a first skew tooth 511 and a first outer annular tooth 512, and the second gear 52 comprises a second skew tooth 521 and a second outer annular tooth 522.

The top face of the push member 54 comprises a first combination portion 541, a second combination portion 542, and a bevel portion 543 connected between the first combination portion 541 and the second combination portion 542. In the embodiment, two first combination portions 541 are included and formed in a convex shape; two second combination portions 542 are included and formed in a concave shape; and two bevel portions 543 are included. The first combination portion 541, the second combination portion 542, and the bevel portion 543 are circularly arranged around the third axis L3, as shown by FIG. 4 and FIG. 5.

Figure 6:
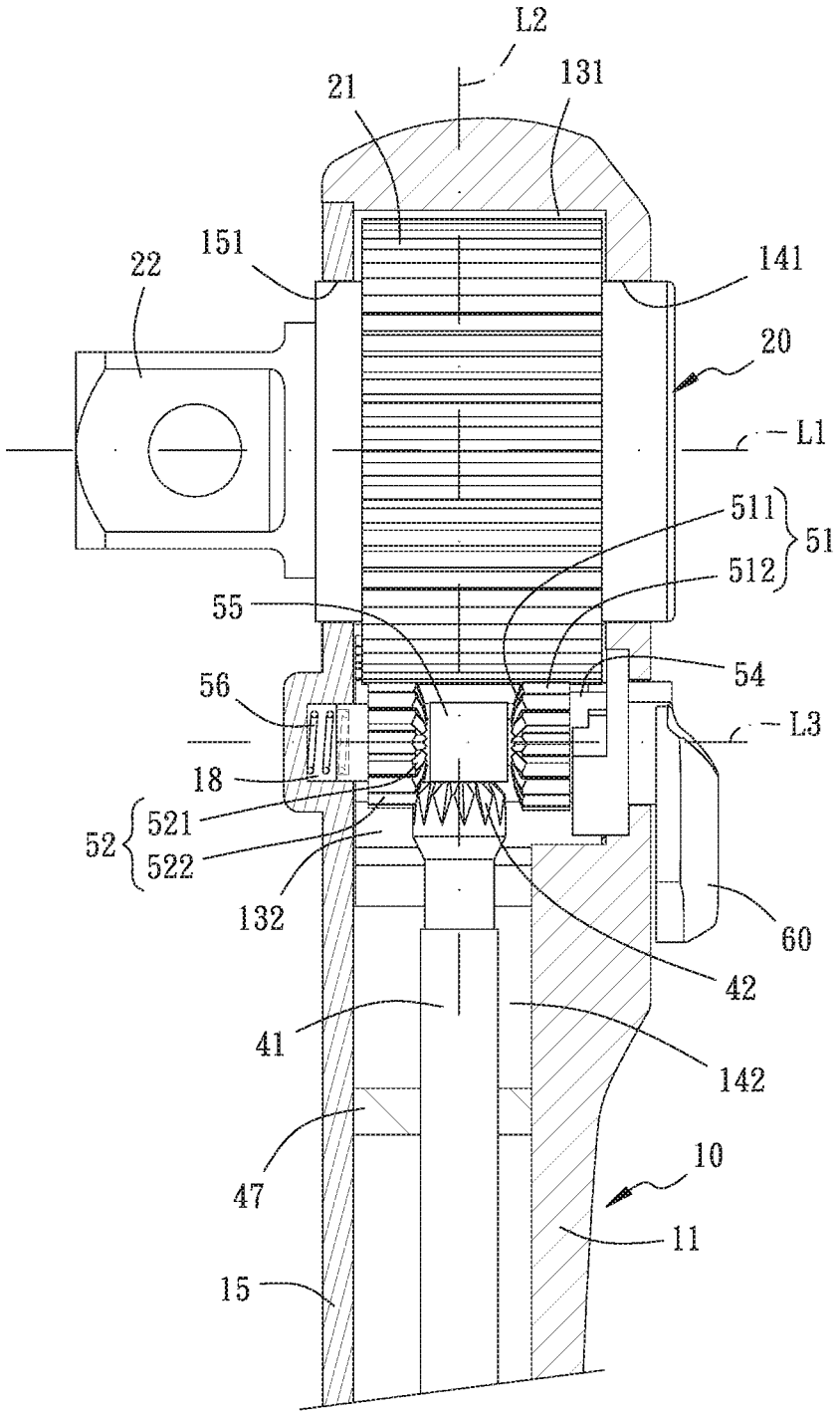
FIG. 6 is a partially sectional view of the ratchet wrench, illustrating that the gear device is at the first position, with the second gear being geared with the transmission gear.
Figure 8:
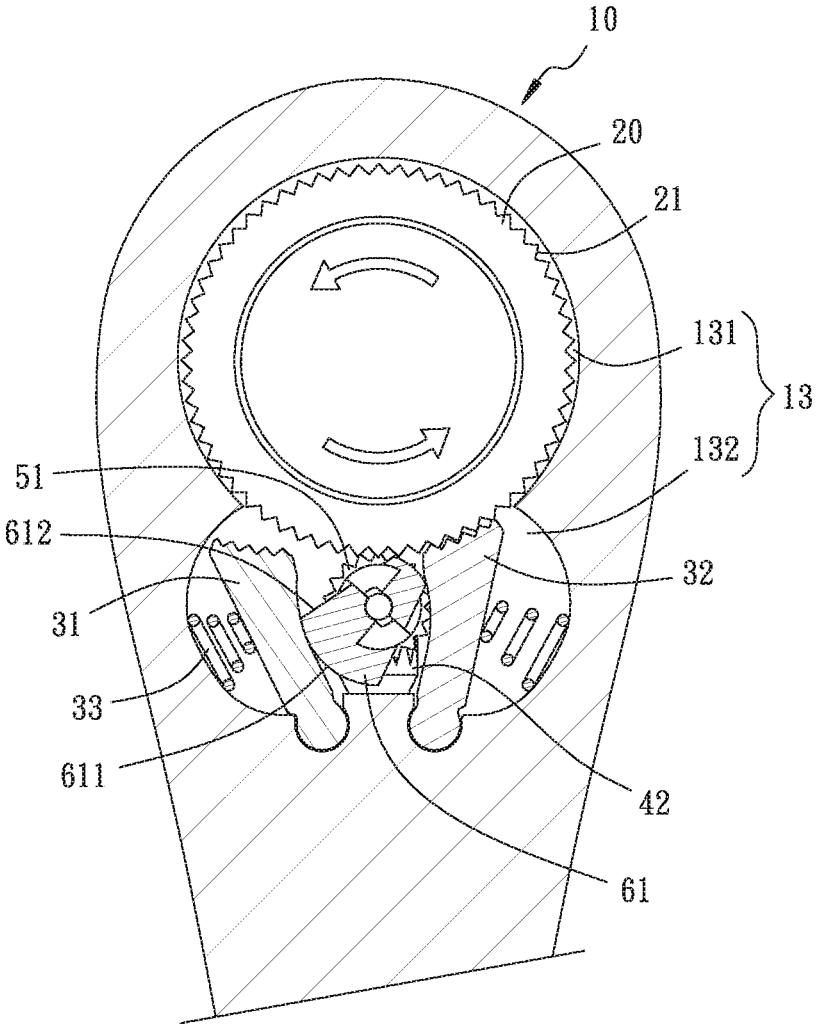
FIG. 8 is a sectional view taken from another point of view, illustrating that the ratchet wrench is able to be operated in a counterclockwise direction.
Figure 9:
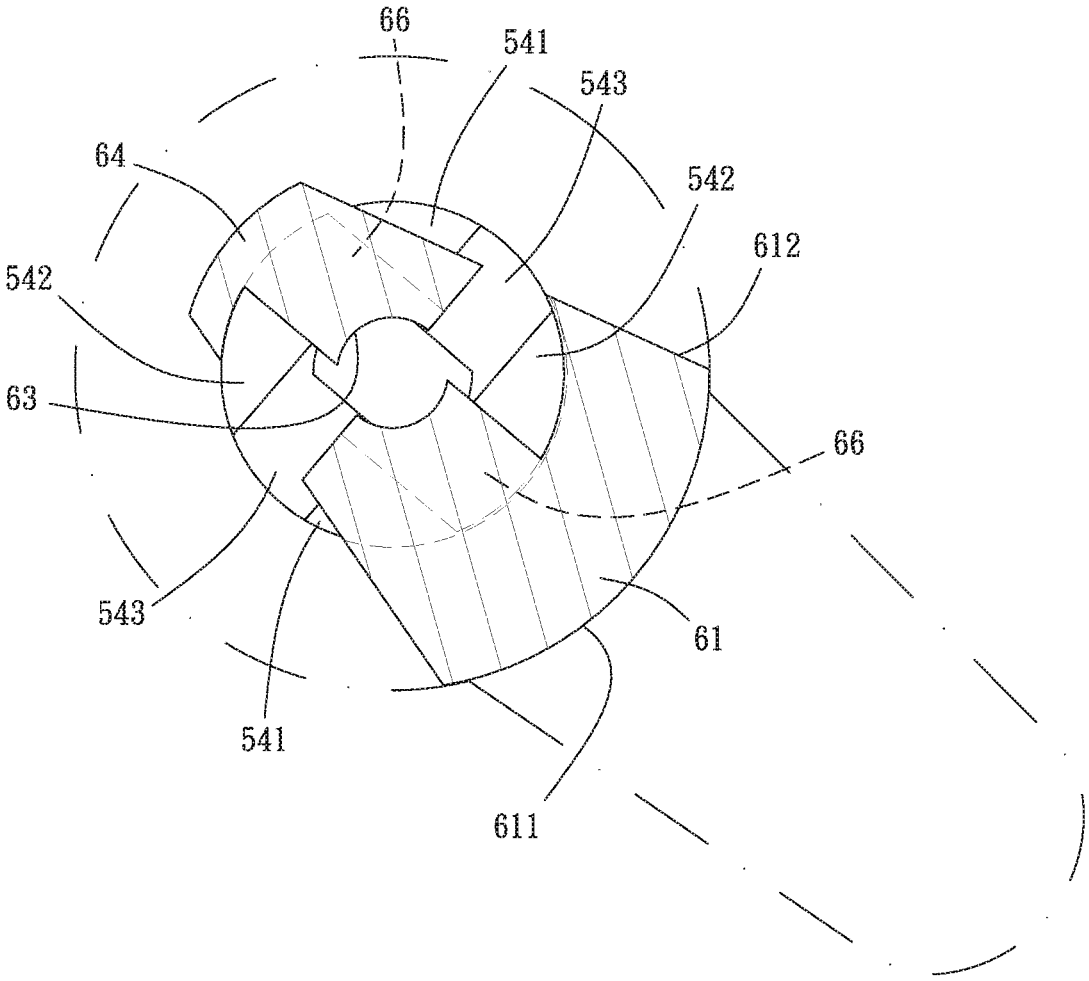
FIG. 9 is a schematic view of the combination of the switch device and the push member, illustrating that when the gear device is at the second position, the first combination portion of the switch device abuts against the first combination portion of the push member.
Figure 11:
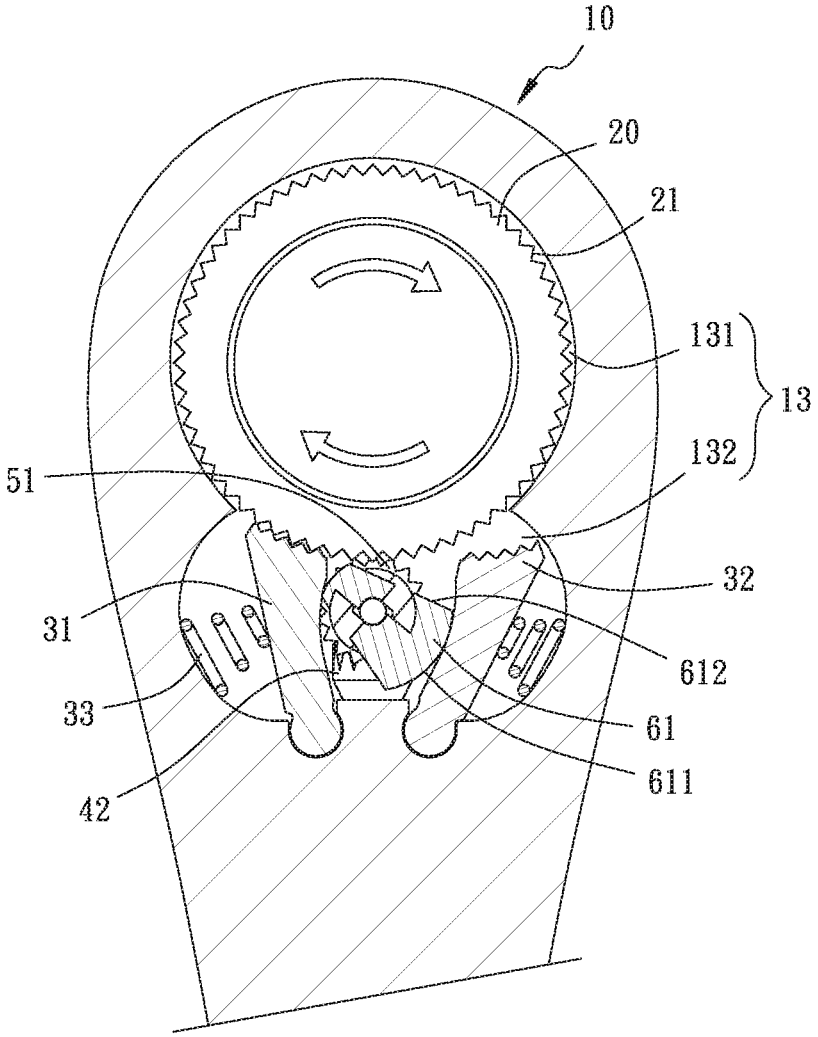
FIG. 11 is a sectional view taken from another point of view, illustrating that the ratchet wrench is able to be operated in a clockwise direction.

The switch device 60 is rotatable disposed on the wrench body 10 and connected with the connection end 531 of the operation shaft 53. The switch device 60 is allowed to be switched between a forward position and a reverse position, thereby facilitating the clockwise and counterclockwise operation of the ratchet wrench 100. The switch device 60 carries the operation shaft 53 to move along the third axis L3 with respect to the wrench body 10. With the elastic member 56 between the wrench body 10 and the operation shaft 53, the push member 54 is kept moving toward the switch device 60. Referring to FIG. 6, when the gear device 50 is at the first position, the first gear 51 leaves the transmission gear 42, with the second gear 52 being geared with the transmission gear 42, wherein the second skew tooth 521 is geared with the transmission gear 42 and the second outer annular tooth 522 is geared with the annular tooth 21, such that the transmission gear 42 drives the annular tooth 21 to rotate through the second gear 52, whereby the ratchet device 20 rotates in the counterclockwise direction, as shown by FIG. 8. Referring to FIG. 9, when the gear device 50 is at the second position, the second gear 52 leaves the transmission gear 42, with the first gear 51 being geared with the transmission gear 42, wherein the first skew tooth 511 is geared with the transmission gear 42 and the first outer annular tooth 512 is geared with the annular tooth 21, such that the transmission gear 42 drives the annular tooth 21 to rotate through the first gear 51, whereby the ratchet device 20 rotates in the clockwise direction, as shown by FIG. 11.

Figure 2:
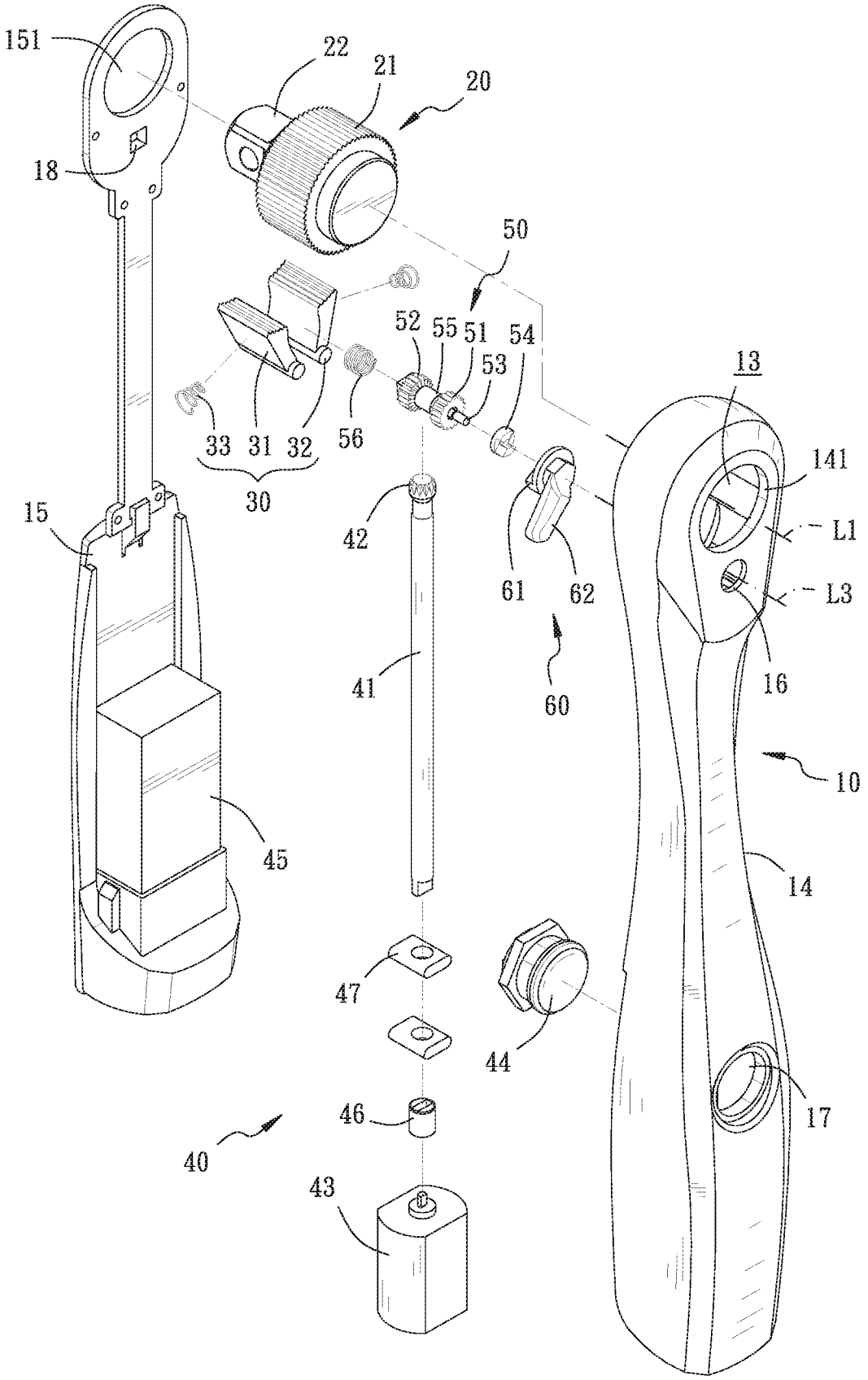
FIG. 2 is an exploded view of the ratchet wrench with electric assistance in accordance with an embodiment of the present invention.
Figure 4:
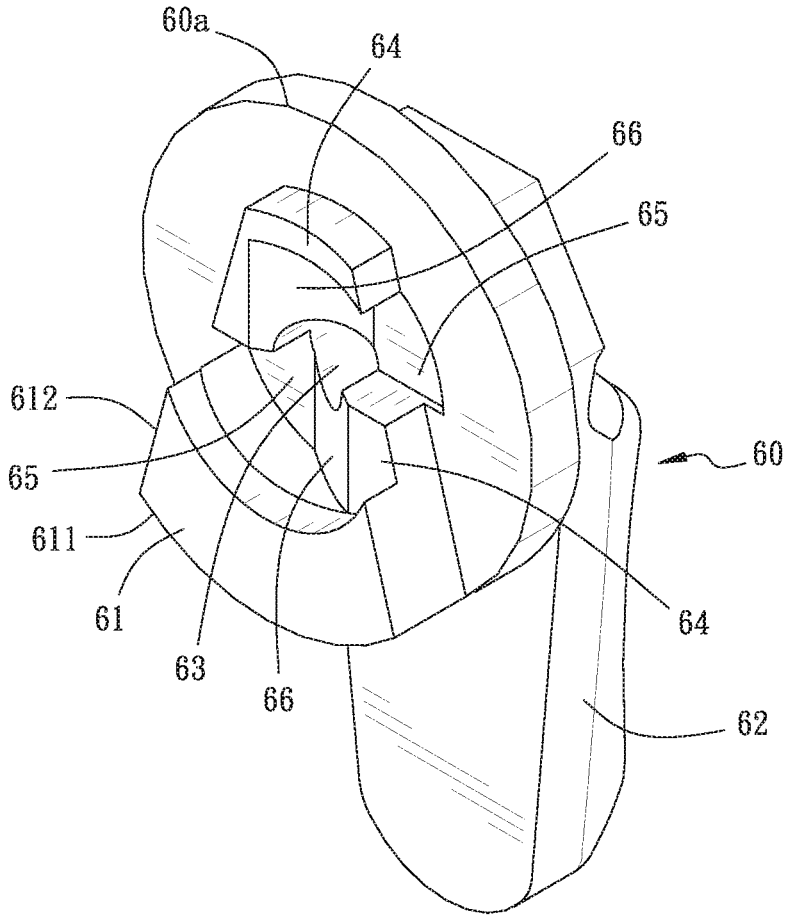
FIG. 4 is a schematic view illustrating the gear device of the ratchet wrench.

In the embodiment, referring to FIG. 2, FIG. 4 and FIG. 5, the switch device 60 is rotatable disposed in the installation bore 16, which is arranged in a coaxial alignment with the third axis L3. The switch device 60 comprises a block plate 60a, which is positioned on an inner side of the installation bore 16 and forms a blockage, so that the switch device 60 is prevented from detachment. The bottom face of the block plate 60a comprises a direction control portion 61, who comprises a pushing face 611 and two lateral faces 612. In the embodiment, the pushing face 611 alternatively abuts against the first pawl 31 or the second pawl 32, such that the first pawl 31 or the second pawl 32 is not geared with the annular tooth 21, as shown by FIG. 8 and FIG. 11. Further, the switch device 60 comprises an operation portion 62 extending from one side in opposite to the block plate 60a. Also, the direction control portion 61 comprises a connection bore 63 at the center thereof, such that the connection end 531 of the operation shaft 53 passes through the connection bore 63.

The push member 54 is engaged between the operation shaft 53 and the switch device 60, so that the push member 64 is allowed to move according to the directional changing rotation of the switch device 60. Referring to FIG. 6, at the first position, the second gear 52 is geared with the transmission gear 42; when the gear device 50 moves from the first position to the second position, the push member 54 forces the operation shaft 53 to drives the first gear 51 to gear the transmission gear 42, and the transmission member 55 is pushed by the first gear 51, so that second gear 52 is pushed to leave the transmission gear 42, whereby the second gear 52 leaves the transmission gear 42, as shown by FIG. 9.

Figure 7:
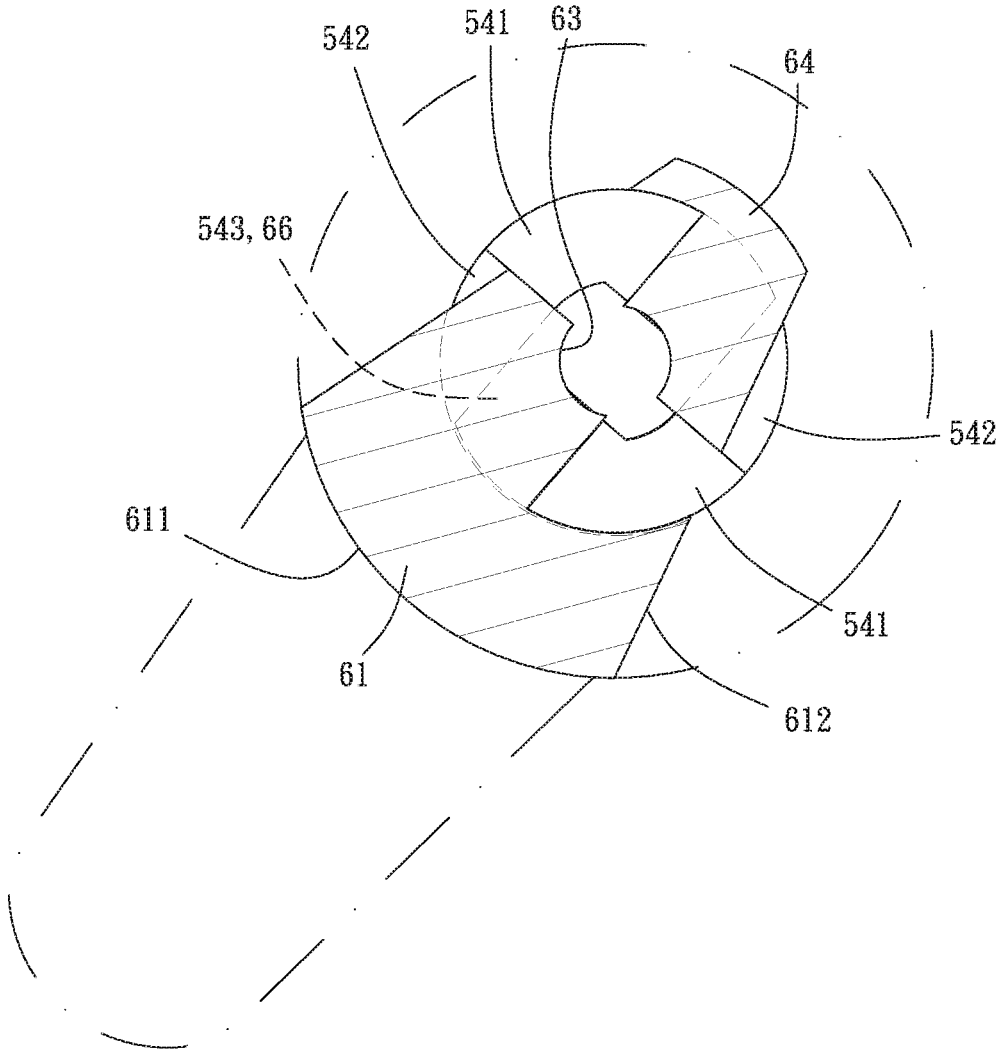
FIG. 7 is a schematic view of the combination of the switch device and the push member, illustrating that when the gear device is at the first position, the switch device and the push member are in a concave-convex combination status.

Furthermore, referring to FIG. 3 to FIG. 6, a front side of the direction control portion 61 of the switch device 60 comprises a first combination portion 64, a second combination portion 65, and a bevel portion 66 that are combined with the first combination portion 541, the second combination portion 542, and the bevel portion 543 of the push member 54 in a concave-convex manner, respectively. As for the direction control portion 61, two first combination portions 64 are included and formed in a convex shape; two second combination portions 65 are included and formed in a concave shape, and two bevel portions 66 are included. The first combination portion 64, the second combination portion 65, and the bevel portion 66 of the direction control portion 61 are circularly arranged around the third axis L3. When the gear device 50 is at the first position, the first combination portion 64 of the switch device 60 is combined with the second combination portion 542 of the push member 54; the second combination portion 65 of the switch device 60 is combined with the first combination portion 541 of the push member 54; and the bevel 66 is abutted and combined with the bevel 543, as shown by FIG. 7. When the gear device 50 moves from the first position to the second position, the first combination portion 64 of the switch device 60 moves to the first combination portion 541 of the push member 54 along the bevel portion 543 of the push member 54, as shown by FIG. 10, so as to force the push member 54 to move on the third axis L3, whereby the first gear 51 is geared with the transmission gear 42, and the second gear 52 leaves the transmission gear 42, as shown by FIG. 6.

Referring to FIG. 8, FIG. 6 and FIG. 7, the switch device 60 is allowed to be switched to the reverse position, such that the pushing face 611 of the direction control portion 61 pushes away the first pawl 31, whereby the first pawl 31 is not geared with the annular tooth 21, and the second pawl 32 is geared with the annular tooth 21. Therefore, the ratchet device 20 is in a counterclockwise rotation status and facilitated for the clockwise rotation operation. As shown by FIG. 6 and FIG. 7, the gear device 50 is at the first position, wherein the switch device 60 and the push member 54 are combined in a concave-convex manner, such that the first gear 51 is not geared with the transmission gear 42, and the second gear 52 is geared between the transmission gear 42 and the annular tooth 21. Accordingly, the transmission gear 42 drives the annular tooth 21 to rotate through the second gear 52, by which the ratchet device 20 is driven by the motivation force transmitted by the transmission shaft 41 to rotate in the counterclockwise direction.

Figure 10:
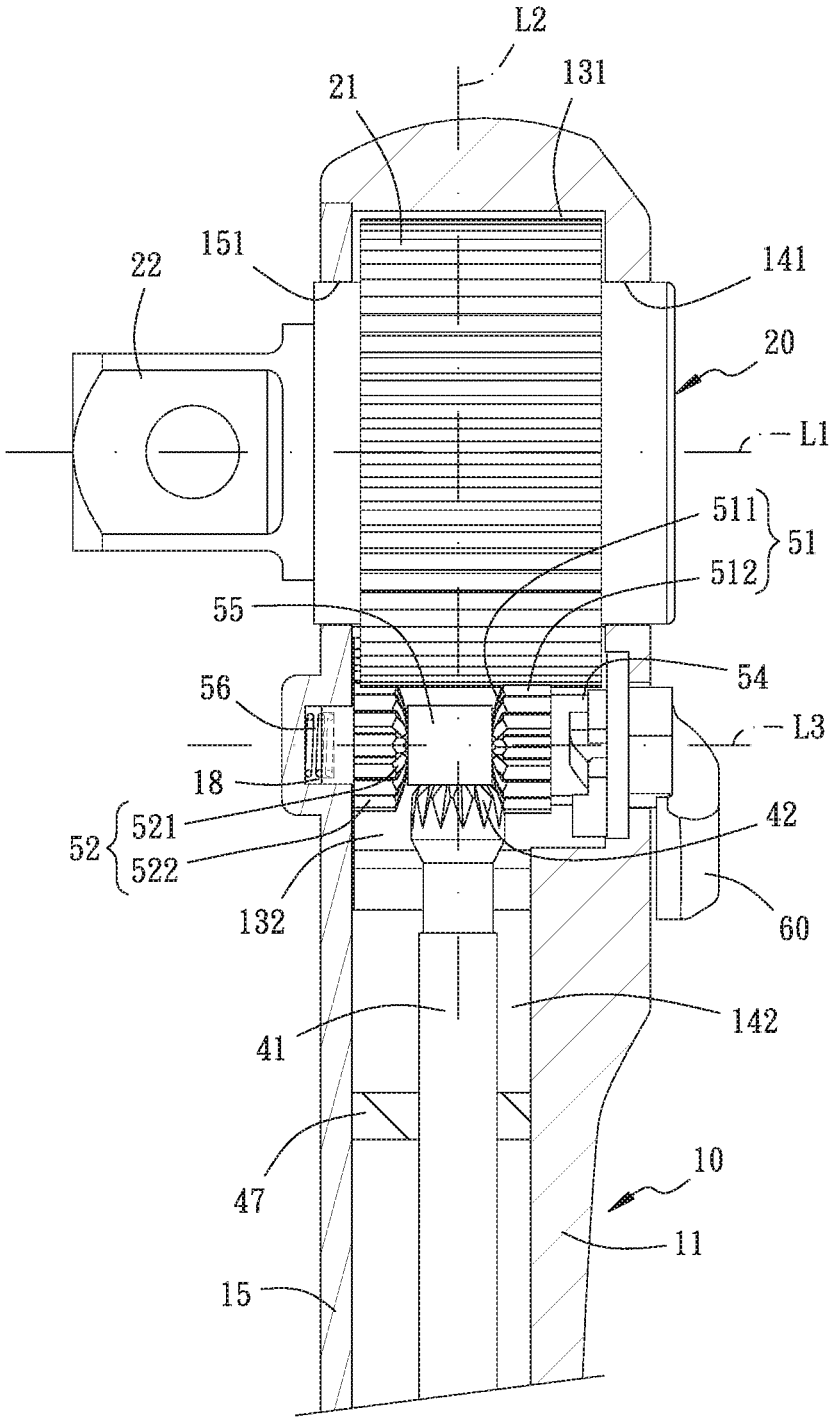
FIG. 10 is a partially sectional view of the ratchet wrench, illustrating that the gear device is at the second position, with the first gear being geared with the transmission gear.

Referring to FIG. 11, FIG. 9 and FIG. 10, the switch device 60 is allowed to be switched to the forward position, such that the pushing face 611 of the direction control portion 61 pushes away the second pawl 32, whereby the second pawl 32 is not geared with the annular tooth 21, and the first pawl 31 is geared with the annular tooth 21. Therefore, the ratchet device 20 is in a clockwise rotation status and facilitated for the counterclockwise rotation operation. As shown by FIG. 9 and FIG. 10, the gear device 50 is at the second position, wherein the switch device 60 is rotated for the first combination portion 64 of the switch device 60 moves along the bevel portion 543 of the push member 54 to the first combination portion 541 of the push member 54, whereby the push member 54 pushes toward the cover body 15 along the third axis L3. Accordingly, the first gear 51 moves toward and geared with the transmission gear 42. Also, the transmission member 55 is simultaneously pushed for forcing the second gear 52 to leave the transmission gear 42. Therefore, the transmission gear 42 drives the annular tooth 21 to rotate through the first gear 51, by which the ratchet device 20 is driven by the motivation force transmitted by the transmission shaft 41 to rotate in the clockwise direction.

With such configuration, the first axis L1 of the present invention is the rotation shaft for driving the sleeve to rotate, such that when being operated with a large torque, the user is allowed to drive the wrench body 10 to rotate in the clockwise or counterclockwise direction with the first axis L1 as the rotation shaft, so as to carry out the wrenching operation upon the sleeve. In a light loading operation status, the operation with a large torque will cause the fastener to rotate together with the ratchet wrench 100, such that the operation is unable to proceed. Therefore, the user can apply the electric mode of the present invention, whereby the ratchet device 20 is electrically driven for driving the fastener in the screwing operation.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A ratchet wrench with electric assistance, comprising:

a wrench body having a grip end and a head end, the head end having a housing groove;

a ratchet device rotatable disposed in the housing groove along a first axis, the ratchet device having an annular tooth;

a pawl device disposed in the housing groove and optionally geared with the annular tooth;

a power device disposed on the wrench body, the power device having a transmission axis driven to rotate by a power;

the transmission axis comprising a transmission gear disposed along a second axis, and the second axis arranged in perpendicular to the first axis;

a gear device disposed in the housing groove along a third axis and movable between a first position and a second position with respective to the wrench body; the third axis arranged in parallel to the first axis; the gear device comprising a first gear, a second gear, and an operation shaft passing through the first gear and the second gear; the operation shaft driving the first gear and the second gear to be optionally geared with the transmission gear for transmitting a motivation force to the annular tooth; and a switch device rotatable disposed on the wrench body and connected with the operation shaft; the switch device driving the operation shaft to move with respect to the wrench body; when the gear device is at the first position, the first gear leaves the transmission gear, and the second gear is geared with the transmission gear, so that the transmission gear drives the annular tooth to rotate through the second gear, such that the ratchet device rotates in a counterclockwise direction; when the gear device is at the second position, the second gear leaves the transmission gear, and the first gear is geared with the transmission gear, so that the transmission gear drives the annular tooth to rotate through the first gear, such that the ratchet device rotates in a clockwise direction.

2. The ratchet wrench of claim 1, further comprising a push member positioned between the operation shaft and the switch device; the push member moves along with a rotation of the switch device; when the gear device is at the first position, the second gear is geared with the transmission gear; when the gear device moves from the first position to the second position, the push member forces the operation shaft for carrying the first gear to be geared toward the transmission gear, with the second gear leaving the transmission gear.

3. The ratchet wrench of claim 2, wherein a transmission member is disposed between the first gear and the second gear; the transmission member is mounted around the operation shaft; when the gear device is at the second position, the transmission gear is pushed by the first gear, such that the second gear is pushed away from the transmission gear.

4. The ratchet wrench of claim 2, wherein each of the push member and the switch device has a first combination, a second combination, and a bevel portion, respectively, that are correspondingly matched; when the gear device is at the first position, the first combination portion of the switch device is combined with the second combination portion of the push member, the second combination portion of the switch device is combined with the first combination portion of the push member, and the bevel portions of the switch device and the push member are combined with each other; when the gear device moves from the first position to the second position, the first combination portion of the switch device moves along the bevel portion of the push member to the first combination of the push member, such that the push member moves.

5. The ratchet wrench of claim 4, wherein each of the push member and the switch device has two first combination portions, two second combination portions, and two bevel portions, that are circularly arranged around the third axis.

6. The ratchet wrench of claim 2, further comprising an elastic member disposed between the ratchet body and the operation shaft, such that the push member is kept moving toward the switch device.

7. The ratchet wrench of claim 6, wherein the operation shaft comprises a connection end and an abut end in opposite to the connection end, with a position portion formed in a non-circular shape, and the push member comprises a non-circular shape engagement bore for matching the position portion.

8. The ratchet wrench of claim 7, wherein the housing groove comprises a spring recess, the connection end is connected with the switch device, and the elastic member is disposed in the spring recess and abuts against the abut end; the switch device comprises a connection bore, through which the connection end passes; both the spring recess and the abut end have a sectional face formed in a non-circular shape.

9. The ratchet wrench of claim 2, wherein the transmission gear is a bevel gear; the first gear comprises a first skew tooth and a first outer annular gear, and the second gear comprises a second skew tooth and a second outer annular gear; when the gear device is at the first position, the second gear is geared with the transmission gear, and the second outer annular gear is geared with the annular tooth; when the gear device is at the second position, the first skew tooth is geared with the transmission gear, and the first outer annular gear is geared with the annular tooth.

10. The ratchet wrench of claim 9, wherein the wrench body comprises an installation bore coaxially disposed with the third axis and in communication with the housing groove, and the switch device is rotatable disposed in the installation bore; the pawl device comprises a first pawl and a second pawl that are pivotally disposed in the housing groove and permanently facing the annular tooth; the switch device comprises a direction control portion, whose periphery comprises a pushing face selectively pushes the first pawl or the second pawl, such that the first pawl or the second pawl is prevented from being geared with the annular tooth; the wrench body comprises a shaft body and a cover body, with the housing groove and the power device disposed between the shaft body and the cover body; the power device comprises a motor, a button, and a battery; the button protrudes from the grip end and is electrically connected with the motor; the motor is transmittably connected with a transmission shaft, and the battery is electrically connected with the motor and the button.

* * * * *